US006420670B1

(12) United States Patent
Yu

(10) Patent No.: US 6,420,670 B1
(45) Date of Patent: Jul. 16, 2002

(54) PUSH-BUTTON TYPE SWITCH

(76) Inventor: Tsung-Mou Yu, No. 4 Alley 2, Lane 23, Sec. 3, Pa Te Road, PanChiao City, Taipei Hsien (TW)

( * ) Notice: Subject to any disclaimer, the term of this patent is extended or adjusted under 35 U.S.C. 154(b) by 0 days.

(21) Appl. No.: 09/802,035

(22) Filed: Mar. 7, 2001

(51) Int. Cl.[7] ..... H01H 3/42
(52) U.S. Cl. ..... 200/524; 200/341
(58) Field of Search ..... 200/524, 290, 200/291, 329, 341; 337/3, 79, 37

(56) References Cited

U.S. PATENT DOCUMENTS 4,924,045 A * 5/1990 Zumkeller et al. ..... 200/341
6,326,572 B1 * 12/2001 Yu ..... 200/254
6,335,500 B1 * 1/2002 Chi et al. ..... 200/341

* cited by examiner

*Primary Examiner*—P. Austin Bradley
*Assistant Examiner*—Lisa N Klaus

(57) ABSTRACT

A push-button type switch includes a box with a button movably inserted in the box and an oscillation member is pivotally connected to a first terminal plate. A curved spring is connected to the oscillation member and a tongue of the button contacts the curved spring so that the oscillation member is pivoted to contact a second terminal plate when the button is pushed. A movable member has a U-shaped guide member which has an end engaged with an enclosed recessed area in the button. The inner periphery of the recessed area positions the end of the U-shaped guide member at open and close position.

9 Claims, 7 Drawing Sheets

PUSH-BUTTON TYPE SWITCH

FIELD OF THE INVENTION

The present invention relates to a push-button type switch that has a U-shaped guide member and one end of the guide member is movably retained in a polygonal recessed area in the button so as to lead the circuit to an open status or a close status.

BACKGROUND OF THE INVENTION

Many conventional push-button type switch employs a button movably receive in a box which has two contact points are controlled to contact with each other to form a circuit close status or to separate from each other to form a circuit open status. The button must be pushed to circulate the open status and the close status. The frequent movement of the conventional button often results in break or delay response which could lead to a dangerous result. Many known push-button type switches known to applicant are disclosed in U.S. Pat. Nos. 4,167,720, 4,937,548, 5,223,813, 5,451,729, and 5,558,211. Some common shortcomings of these switch disclosed in the patents are too many parts involved in the switch and high possibilities of dysfunction happened. A flexible plate is pushed by the button frequently and the difference of temperature of the flexible plate accelerate the flexible to be broken. U.S. Pat. No. 5,223,813 discloses a switch that cannot resolve the potential problem of the flexible plate and each of the parts has a complicated shape.

The present invention intends to provide a push-button type switch that has simple structure and the button pushes or releases a movable member which is more reliable.

SUMMARY OF THE INVENTION

In accordance with one aspect of the present invention, there is provided a push-button type switch and comprising a box having a button movably inserted in an open top of the box. A tubular member extends from an underside of the button and a spring is biased between the tubular member and the box. A tongue extends from an underside of the button and a recessed area is defined in a surface of the tubular member. The recessed area has a polygonal inner periphery and a central member is located in a center of the recessed area. A first terminal plate and a second terminal plate respectively extend from a bottom of the box, and a first contact point is connected to the first terminal plate. A board extends from an inner side of the box and a hole is defined in a surface of the board. Two rods respectively extend from the inner side of the box.

A movable member has two slots and the rods are movably received in the two slots. A U-shaped guide member has a leg extending through the movable member and engaged with the recessed area. The other leg of the U-shaped guide member is inserted in the hole in the board. An oscillation member has a first end pivotally connected to the second terminal plate and a second end of the oscillation member has a second contact point connected thereto. A curved spring has an end fixedly connected to the box and the other end of the curved spring is connected to the oscillation member. The tongue contacts the curved spring.

The object of the present invention is to provide a push-button type switch that has a button having a polygonal recess to retain a guide member so as to push an oscillation member toward and contact a terminal plate.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
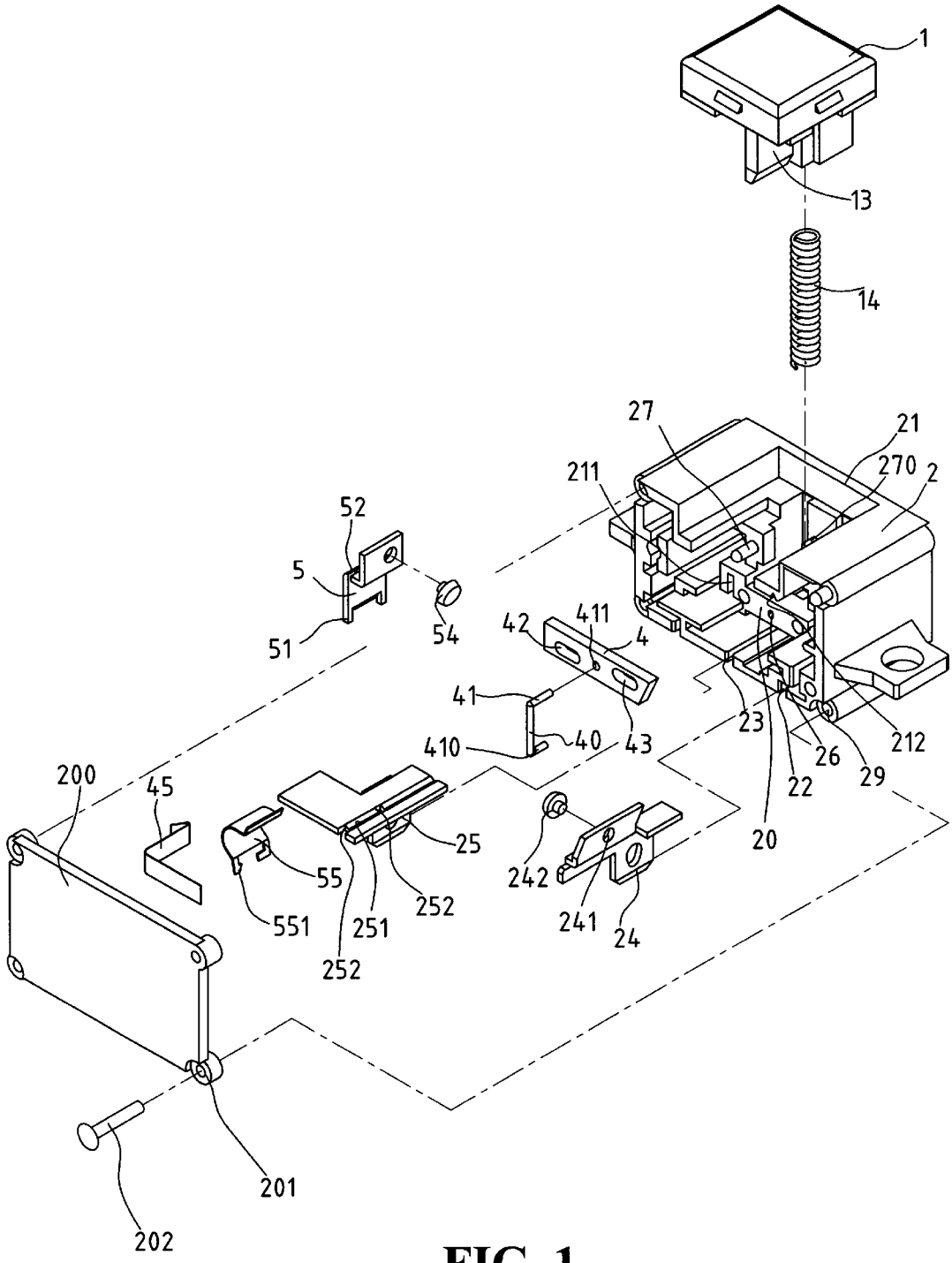
FIG. 1 is an exploded view to show the push-button type switch of the present invention.
Figure 2:
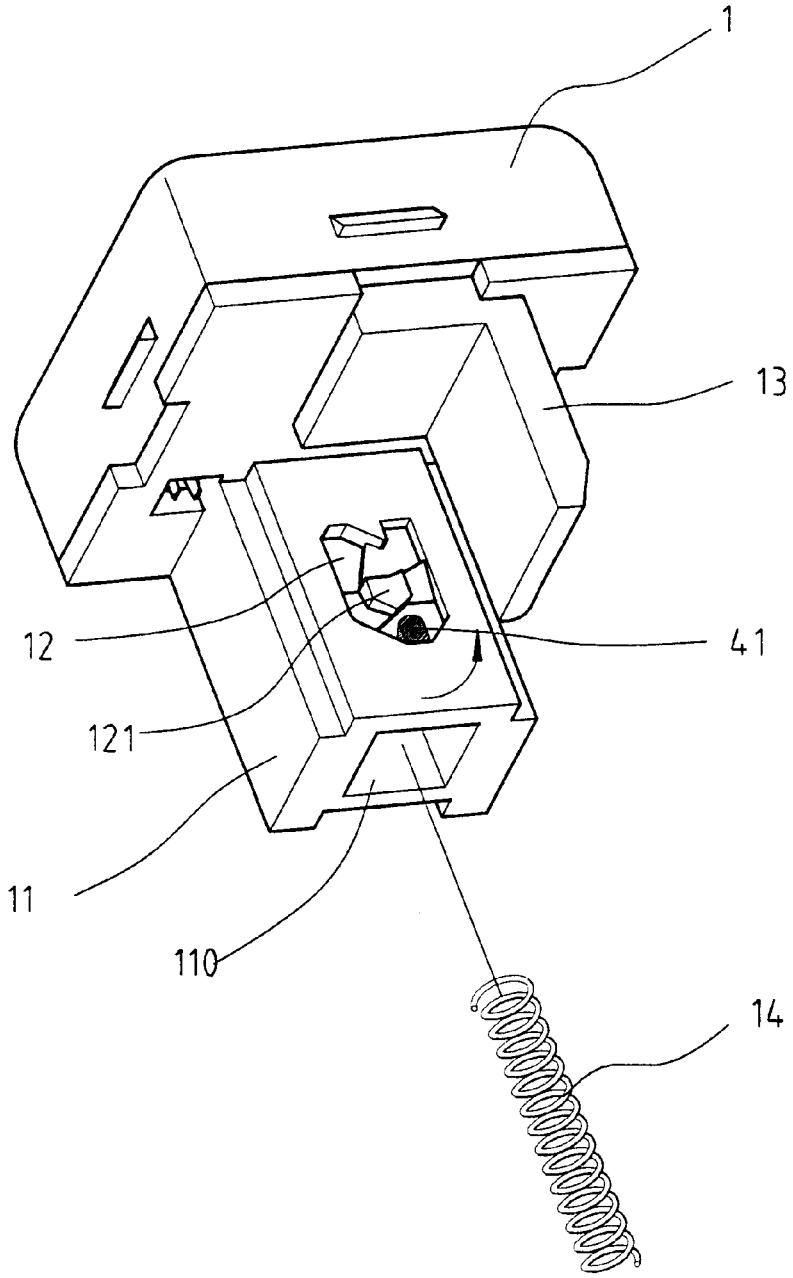
FIG. 2 is an exploded view to show a push button and a spring of the present invention.
Figure 3:
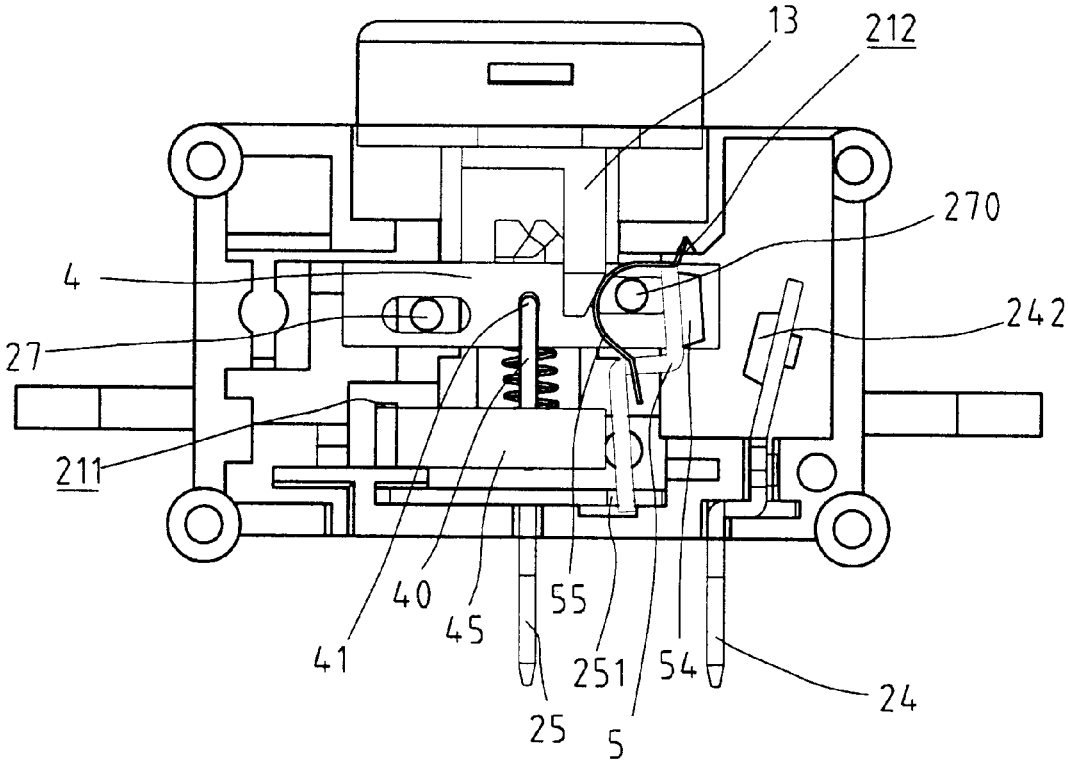
FIG. 3 is an illustrative view to show an open circuit status of the push-button type switch of the present invention.
Figure 5D:
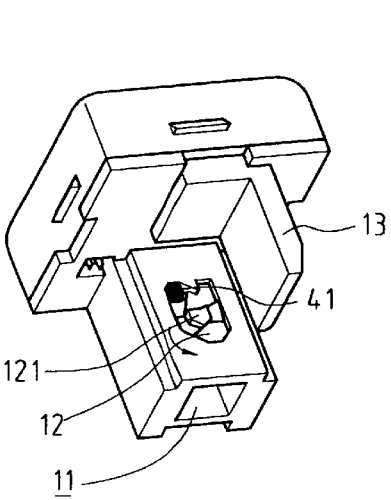
FIG. 5*d* shows the position of the leg of the U-shaped guide member in the recessed area of the push button when the button is pushed to open the circuit.
Figure 5C:
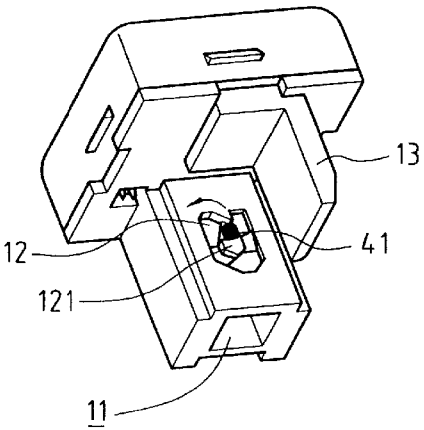
FIG. 5*c* shows the position of the leg of the U-shaped guide member in the recessed area of the push button when the circuit is in close position.
Figure 5B:
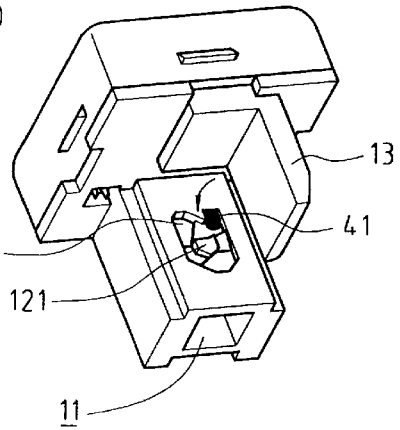
FIG. 5*b* shows the position of the leg of the U-shaped guide member in the recessed area of the push button when the button is pushed to close the circuit.
Figure 5A:
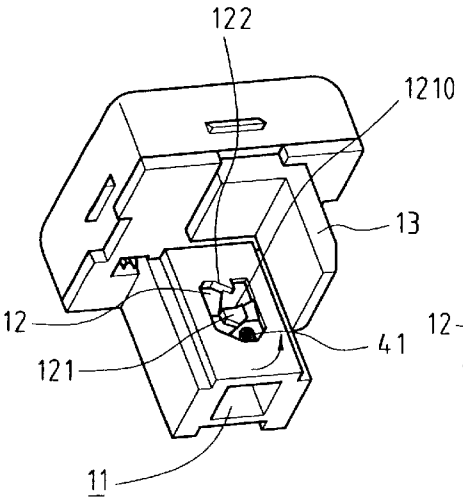
FIG. 5*a* shows the position of a leg of the U-shaped guide member in the recessed area of the push button when the circuit is in open position.

Referring to FIGS. 1 to 3, the push-button type switch in accordance with the present invention comprises a box 2 having a button 1 movably inserted in an open top 21 of the box 2. A tubular member 11 extends from an underside of the button 1 and a hole 110 is defined in an underside of the tubular member 11 so as to receive one end of a spring 14 therein. The other end of the spring 14 contacts an inner side of the box 1. A tongue 13 extends from an underside of the button 1 and has an inclined surface. A recessed area 12 is defined in a surface of the tubular member 11 and the recessed area 12 has a polygonal inner periphery. A central member 121 is located in a center of the recessed area 12 and a dent 1210 is defined in a top of the central member 121 as shown in FIG. 5*a*. A triangle plate 122 extends from the inner periphery of the recessed area 12 and is located above the dent 1210 of the central member 121.

A first terminal plate 24 and a second terminal plate 25 respectively extend from two slits 22, 23 defined in a bottom of the box 2. A board 20 extends from an inner side of the box 2 and a hole 26 is defined in a surface of the board 20 and a recess 211 is defined in an underside of the board 20. Two rods 27, 270 respectively extend from the inner side of the box 2. A first contact point 242 extends through a hole 241 in a top of the first terminal plate 24. A movable member 4 has two slots 42, 43 defined therethrough and the two rods 27, 270 are movably received in the two slots 42, 43. A U-shaped guide member 40 has a leg 41 thereof extending through a hole 411 in the movable member 4 and is movably engaged with the recessed area 12. The other leg 410 of the U-shaped guide member 40 is inserted in the hole 26 in the board 20.

The second terminal plate 25 has a groove 251 defined in a top thereof and two notches 252 are defined through an inner periphery of the groove 251. A first end of an oscillation member 5 is pivotally received in the groove 251 and two protrusions 51 extend from the first end of the oscillation member 5. The two protrusions 51 are engaged with the two notches 252. Accordingly, the oscillation member 5 is pivoted about the first end of the oscillation member 5. A second end of the oscillation member 5 has a second contact point 54 connected thereto. A curved spring 55 has an end fixedly received in a notch 212 of the board 20 and the other end of the curved spring 55 has two lugs 551 extending through slots 52 in the oscillation member 5. The inclined surface of the tongue 13 contacts the curved spring 55. An L-shaped spring 45 has one end engaged with the recess 211 and the other end of the L-shaped spring 45 pushes the U-shaped guide member 40 toward the recessed area 12 of the button 1. A cover 20 is connected the box 2 to receive the parts mentioned above in the box 2 by screws or rivets 202 extending through holes 201 in the cover 20 and engaged with the holes 29 in the box 2.

Figure 4:
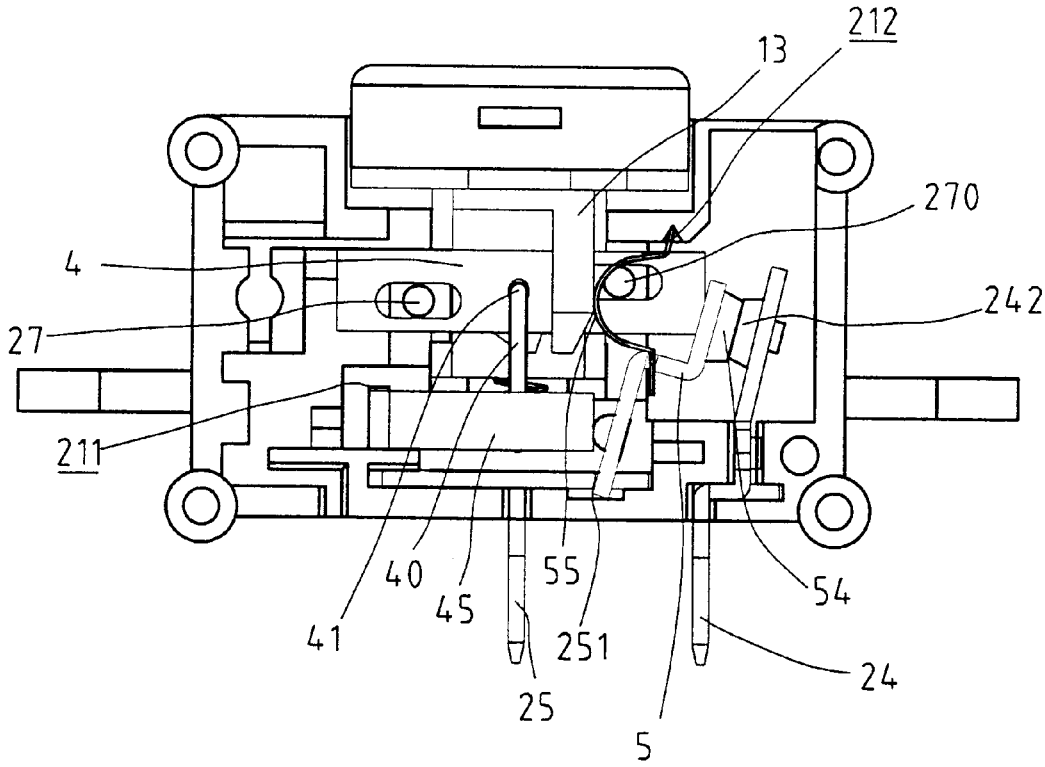
FIG. 4 is an illustrative view to show a close circuit status of the push-button type switch of the present invention by pushing the button.

When the circuit is in open status, the button 1 is located at the highest position by the spring 14 and the leg 41 is located at a lowest position in the recessed area 12 as shown in FIG. 5*a*. A gap is defined between the first contact point 242 and the second contact point 54. As shown in FIG. 4, when the button 1 is pushed to close the circuit, the curved spring 55 is pushed by the downward movement of the tongue 13, the oscillation member 5 is then pivoted to the second contact point 54 contact the first contact point 34 to form a close circuit. In the mean while, referring to FIG. 5*b*, the leg 41 of the U-shaped guide member 40 is moved counter-clockwise. When the user releases the button 1, the button 1 slightly moves upward and the leg 41 is in the dent 1210 and located between the triangle plate 122 and the central member 1211 as shown in FIG. 5*c*. When the button 1 is pushed again, the circuit will be opened and the leg 41 is moved as shown in FIG. 5*d*.

Figure 6:
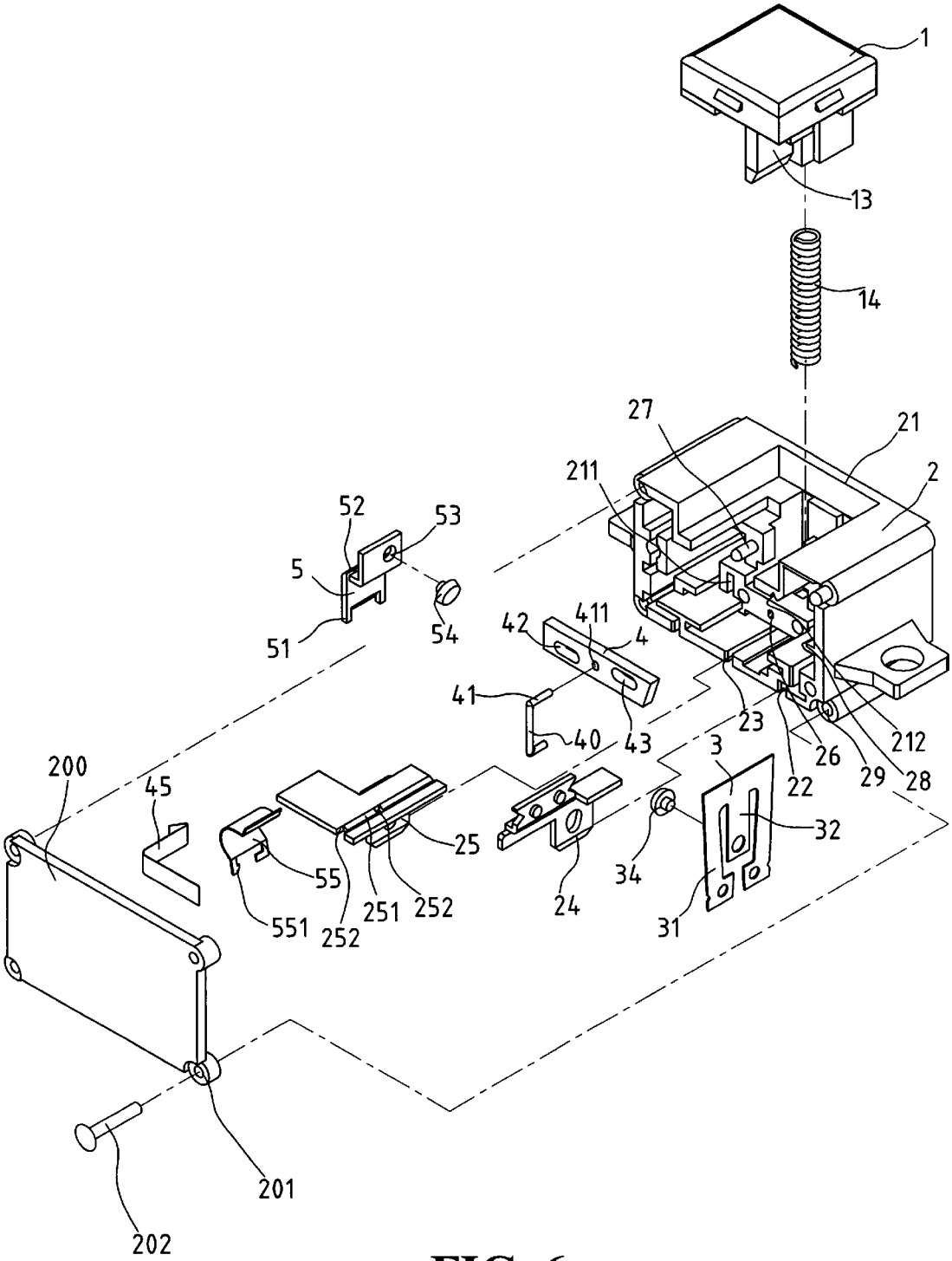
FIG. 6 is an exploded view to show another embodiment of the present invention and a bimetal plate is used to connected to the first terminal plate.

FIG. 6 shows another embodiment of the switch which further includes a U-shaped bimetal plate 3 and a central plate 32 is connected to the bimetal plate 3 and is located between two legs 31 of the U-shaped bimetal plate 3. The first contact point 34 is connected to the central plate 32 and the two legs 31 of the bimetal plate 3 is fixedly connected to a top of the first terminal plate 24.

Figure 7:
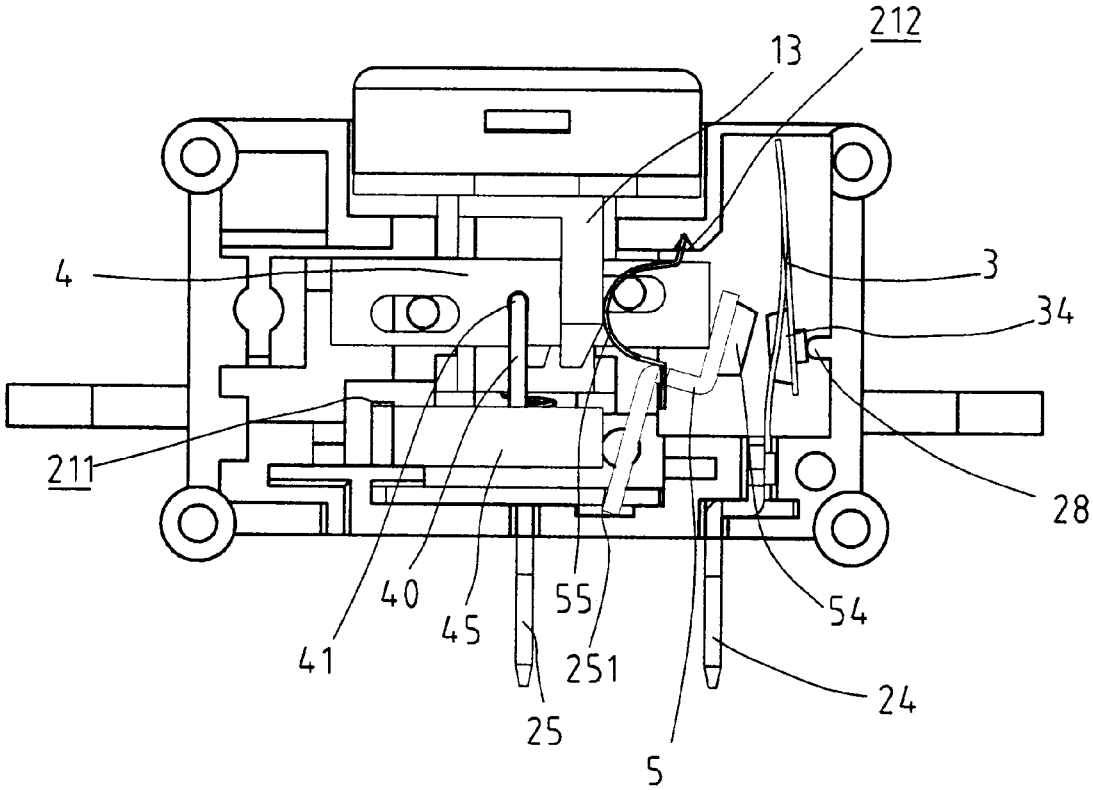
FIG. 7 is an illustrative view to show an open circuit status of the switch of the present invention when the bimetal plate is deformed when override.

FIG. 7 shows that the bimetal plate 3 is deformed when override, the central plate 32 is deformed toward the right so as to separate from the second contact point 54. A boss 28 extends from an inside of the box 1 and contacts the central plate 32 of the bimetal plate 3 when the bimetal plate 3 is deformed. The boss 28 prevents the central plate 32 of the bimetal plate 3 from being over deformed.

While we have shown and described various embodiments in accordance with the present invention, it should be clear to those skilled in the art that further embodiments may be made without departing from the scope and spirit of the present invention.

What is claimed is:

1. A push-button type switch comprising:

a box having a button movably inserted in an open top of said box, a tubular member extending from an underside of said button and a spring biased between said tubular member and said box, a tongue extending from an underside of said button and a recessed area defined in a surface of said tubular member, said recessed area defined by a polygonal inner periphery and a central member located in a center of said recessed area, a first terminal plate and a second terminal plate respectively extending from a bottom of said box, a board extending from an inner side of said box and a hole defined in a surface of said board, two rods respectively extending from said inner side of said box;

a movable member having two slots defined therethrough and said two rods movably received in said two slots, a U-shaped guide member having a leg thereof extending through said movable member and movably engaged with said recessed area, the other leg of said U-shaped guide member inserted in said hole in said board, and an oscillation member having a first end pivotally connected to said second terminal plate, a curved spring having an end fixedly connected to said box and the other end of said curved spring connected to said oscillation member, said tongue contacting said curved spring, a second end of said oscillation member pivoted to contact said first terminal plate when said button is pushed.

2. The switch as claimed in claim 1, wherein said second terminal plate has two notches defined in a top thereof and two protrusions extend from said first end of said oscillation member, said two protrusions engaged with said two notches.

3. The switch as claimed in claim 2, wherein said second terminal plate has a groove defined in said top thereof and said first end of said oscillation member pivotally received in said groove.

4. The switch as claimed in claim 1, further comprising a recess defined in an underside of said board and an L-shaped spring has one end engaged with said recess, the other end of said L-shaped spring pushing said U-shaped guide member toward said recessed area of said button.

5. The switch as claimed in claim 1, further comprising an inclined surface defined in said tongue and said inclined surface contacting said curved spring.

6. The switch as claimed in claim 1 wherein said tubular member has a hole defined in an underside thereof so as to receive one end of said spring therein.

7. The switch as claimed in claim 1, further comprising a dent defined in a top of said central member and a triangle plate extends from said inner periphery of said recessed area, said triangle plate located above said dent of said central member.

8. The switch as claimed in claim 1, further comprising a U-shaped bimetal plate having a central plate located between two legs of said U-shaped bimetal plate, said two legs of said bimetal plate fixedly connected to a top of said first terminal plate, said second end of said oscillation member pivoted to contact said central plate of said U-shaped bimetal plate when said button is pushed.

9. The switch as claimed in claim 8, further comprising a boss extending from an inside of said box and contacting said central plate of said bimetal plate when said bimetal plate is deformed.

* * * * *